US005551737A

United States Patent [19]

Clavin

[11] Patent Number: 5,551,737

[45] Date of Patent: Sep. 3, 1996

[54] SINGLE-POINT SELF-CLOSING LATCH

[75] Inventor: Timothy J. Clavin, Corona, Calif.

[73] Assignee: Hartwell Corporation, Placentia, Calif.

[21] Appl. No.: 533,694

[22] Filed: Sep. 26, 1995

[51] Int. Cl.[6] ..... E05C 1/12

[52] U.S. Cl. ..... 292/169; 292/169.19; 292/DIG. 37

[58] Field of Search ..... 292/169, 169.11, 292/170, 140, DIG. 31, DIG. 37, 169.19

[56] References Cited

U.S. PATENT DOCUMENTS

| | | | |
|---|---|---|---|
| 2,485,042 | 10/1949 | Friend | 292/337 |
| 2,542,130 | 2/1951 | Friend | 292/174 |
| 2,674,484 | 4/1954 | Friend | 292/336.3 |
| 2,784,993 | 3/1957 | Collar | 292/223 |
| 2,825,219 | 3/1958 | Marzillier | 70/488 |
| 4,527,821 | 7/1985 | Tanaka | 292/19 |
| 4,676,081 | 6/1987 | Craig | 70/169 |
| 5,496,078 | 3/1996 | Yasuda | 292/165 |

FOREIGN PATENT DOCUMENTS

| | | | |
|---|---|---|---|
| 2242223 | 9/1991 | United Kingdom | 292/169 |

OTHER PUBLICATIONS

Eberhard Manufacturing, "Handbook of Latches, Locks, Hinges, Handles and Related Hardware No. 103", 1985, pp. 26, 27, 28 and 29.

Eberhard Manufacturing catalog, "Industrial and Vehicular Hardware", 1991, pp. 64 and 65.

*Primary Examiner*—Steven N. Meyers
*Assistant Examiner*—Donald J. Lecher
*Attorney, Agent, or Firm*—Harris, Wallen, MacDermott & Tinsley

[57] ABSTRACT

A single-point latch for a door, having a housing, a bolt mounted in the housing for sliding along a first axis, an actuator mounted in the housing for sliding along a second axis perpendicular to the first axis, and first and second handles mounted in the housing for sliding along a third axis perpendicular to the first and second axes. The latch further includes a first spring arrangement carried in the handles for urging the handles apart, with the handles and the actuator having first interengaging cam surfaces for moving the actuator along the second axis by movement of the handles along the third axis toward each other, the actuator and bolt having second interengaging cam surfaces for moving the bolt inward into the housing along the first axis by the movement of the handles along the third axis, and a second spring carried in the housing for urging the bolt outward from the body to a latched position.

6 Claims, 4 Drawing Sheets

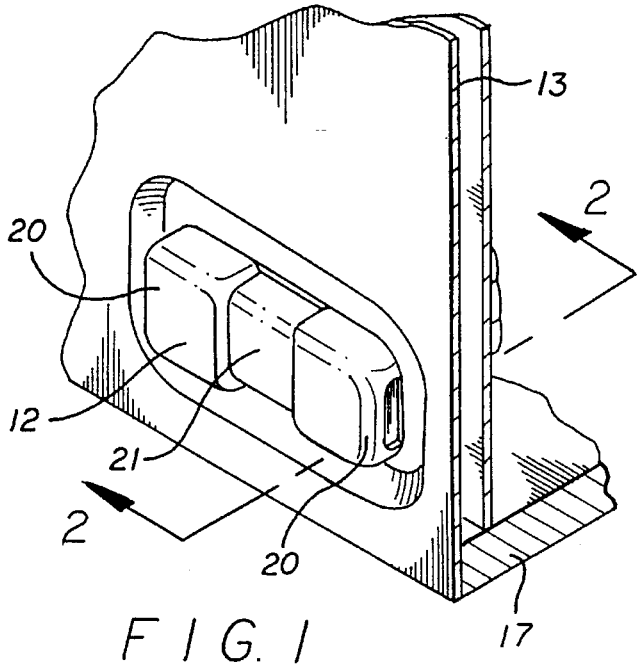
FIG. 1
FIG. 2
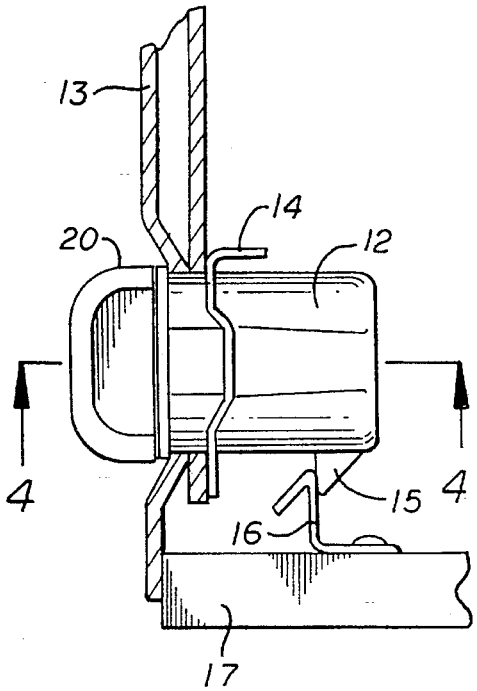
FIG. 4
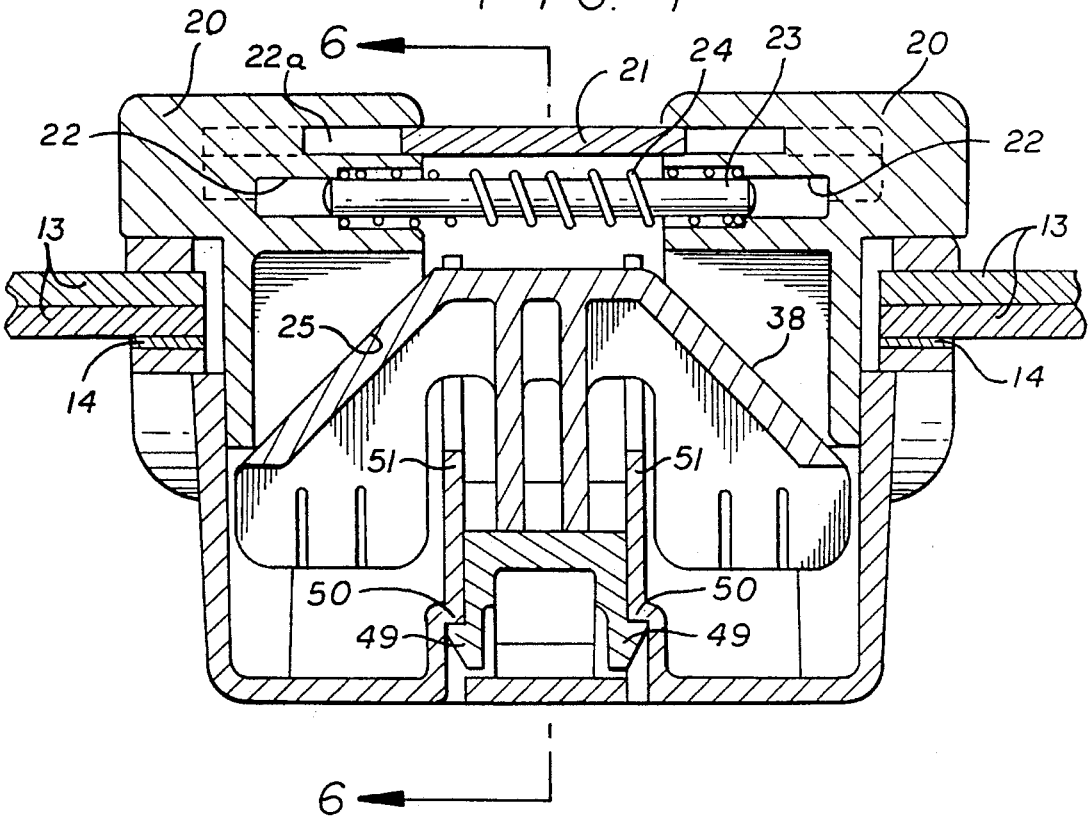

SINGLE-POINT SELF-CLOSING LATCH

BACKGROUND OF THE INVENTION

This invention relates to a new and improved self-closing latch suitable for use with a door of a glove compartment of an automobile or the like. More particularly, the invention relates to a self-closing latch having opposed handles which are squeezed to slide toward each other causing the latching bolt to retract along an axis perpendicular to the slide axis of the handles.

Similar types of latches have been utilized in the past. These prior types of latches typically are two-point latches where the latching bolts retract along the same axis as the handle squeezing axis. This motion is accomplished by pivoted levers with a scissors configuration with bolt movement produced by squeezing the handles together.

It is an object of the present invention to provide a new and improved single-point latch which utilizes the same handle squeezing function for unlatching as in the prior art constructions, while actuating a single bolt along an axis perpendicular to the squeeze axis of the handles. A further object of the invention is to provide such a latch wherein bolt action is produced by sliding cam surfaces rather than direct interconnection between components. An additional object is to provide such a latch which can be constructed of a plurality of components which are snapped together, without requiring direct connection of components.

Other objects, advantages, features and results will more fully appear in the course of the following description.

SUMMARY OF THE INVENTION

The presently preferred embodiment of the invention is a single-point latch for a door, and having a housing, a bolt in the housing for sliding along a first axis, an actuator in the housing for sliding along a second axis perpendicular to the first axis, and first and second handles in the housing for sliding along a third axis perpendicular to the first and second axes. The latch further includes first spring means carried in the handles for urging the handles apart, with the handles and the actuator having first inter-engaging cam surfaces for moving the actuator along the second axis by movement of the handles along the third axis toward each other, the actuator and bolt having second interengaging cam surfaces for moving the bolt inward into the housing along the first axis by movement of the handles along the third axis, and second spring means carried in the housing for urging the bolt outward from the body to a latched position.

The latch also preferably includes a guide positioned in the housing between the handles and overlying the actuator, and having aligned slots along the third axis, with each of the handles having a rib for sliding engagement with one of the guide slots.

BRIEF DESCRIPTION OF THE DRAWINGS

FIG. 1 is a perspective view illustrating the installation of a latch incorporating the presently preferred embodiment of the invention in a door panel;

FIG. 2 is an enlarged sectional view taken along the line 2—2 of FIG. 1;

FIG. 4 is an enlarged sectional view taken along the line 4—4 of FIG. 2, showing the latch in the latched or rest position;

DESCRIPTION OF THE PREFERRED EMBODIMENT

Figure 3:
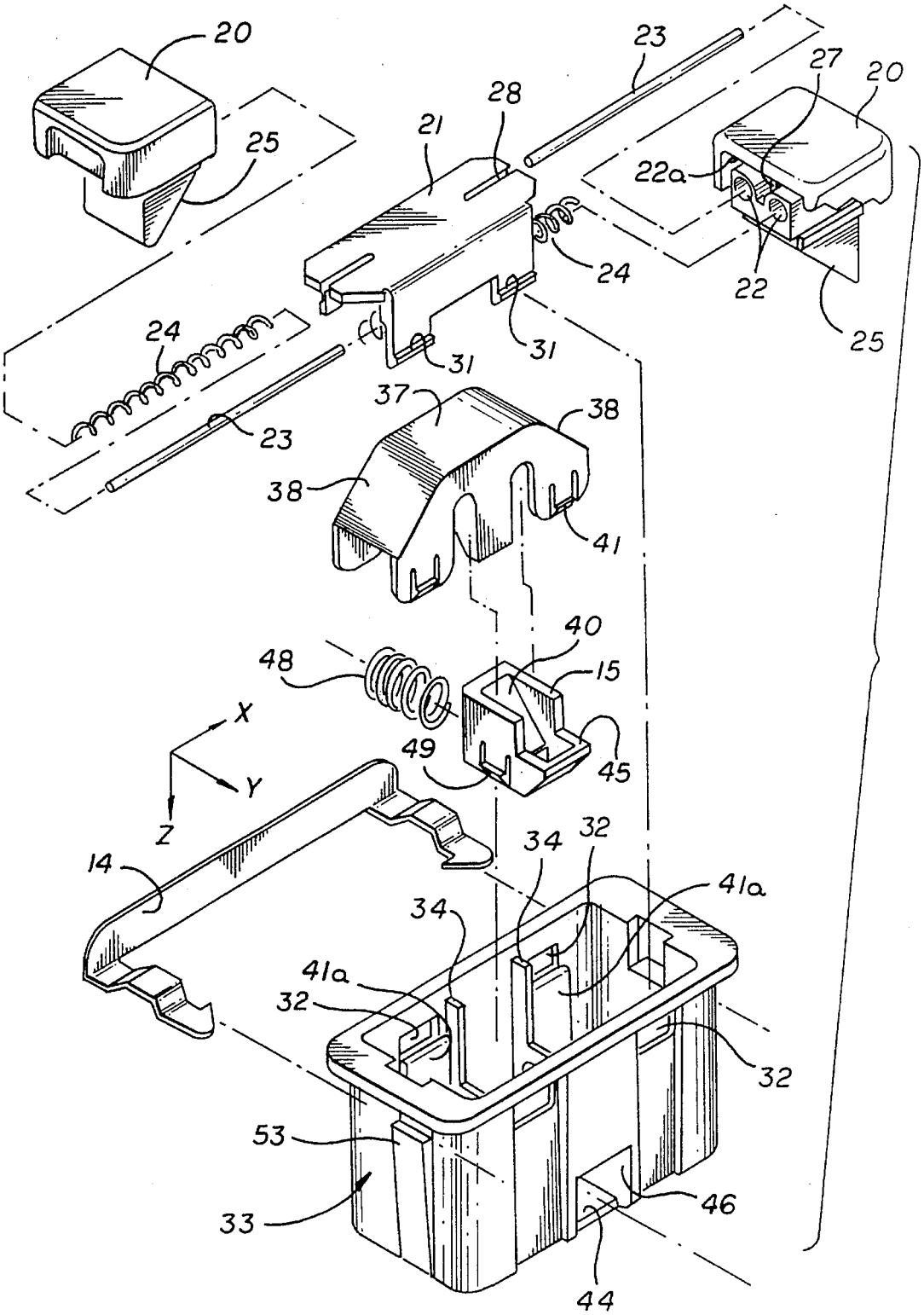
FIG. 3 is an exploded view of the latch of FIG. 1.
Figure 5:
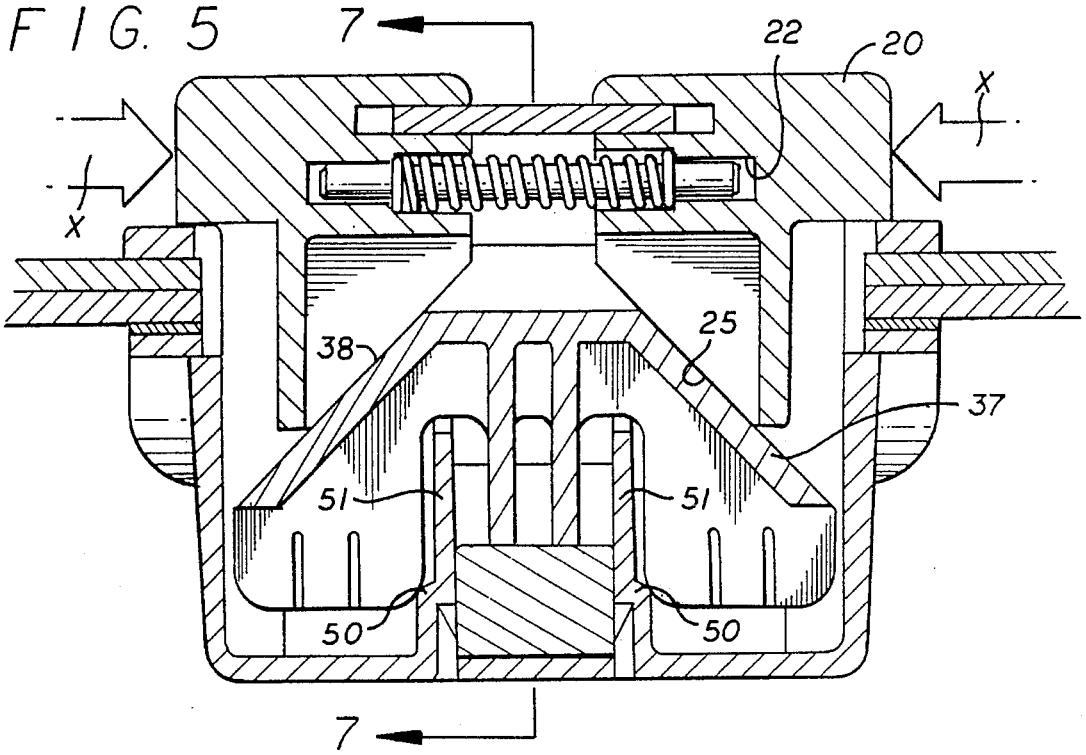
FIG. 5 is a view similar to that of FIG. 4 showing the latch in the unlatching condition.

FIGS. 1 and 2 illustrate the mounting of the single point latch 12 incorporating the presently preferred embodiment of the invention, in a door 13 of an automobile glove compartment or the like. The latch is placed through an opening in the door and is held in place by a spring steel retainer clip 14. When the door is closed, a bolt 15 of the latch engages a strike 16 carried on a base 17 of the compartment.

The latch includes two handles 20 which slide on opposite ends of a U-shaped guide 21. Each handle has two two-step holes 22, each having a deeper section for a mandrel 23 and a shallower section for a spring 24. Each handle has a U-shaped interior groove **22*a* for receiving an end of the guide. Each handle also has an actuator cam surface 25, and desirably has a rib 27 for riding in a slot 28 of the guide 21**.

The guide 21 is U-shaped with lugs 31 on depending sides of the guide, with the lugs fitting into openings 32 of a housing 33 and with the guide engaging guide stops 34 when the guide is installed in the housing.

Figure 10:
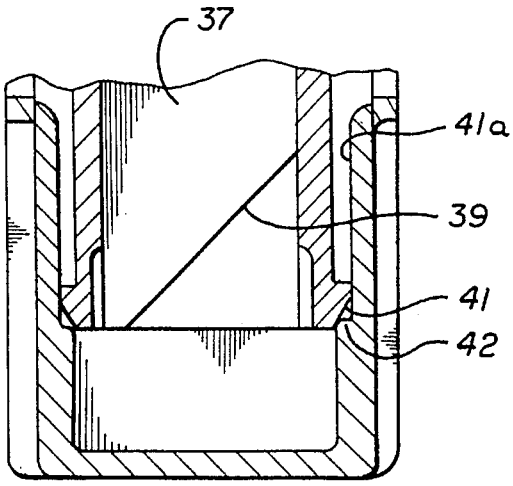
FIG. 10 is a sectional view taken along the line 10—10 of FIG. 9.

An actuator 37 slides in the housing 33 below the guide 21 and handles 20. The actuator has opposed handle cam surfaces 38 which engage the cam surfaces 25 of the respective handles 20. The actuator has a bolt cam surface 39 which engages a cam surface 40 of the bolt 15. Lugs 41 project from the sides of the actuator 37 and engage stops 42 within the housing for limiting downward motion of the actuator. See FIG. 10. The lugs 41 bear outward against the interior wall of the housing, such as against surfaces **41*a***, to provide some sliding resistance or friction to maintain the actuator in position in the housing. At the same time, the downward force on the actuator applied by the handles is great enough to overcome such resistance.

Figure 6:
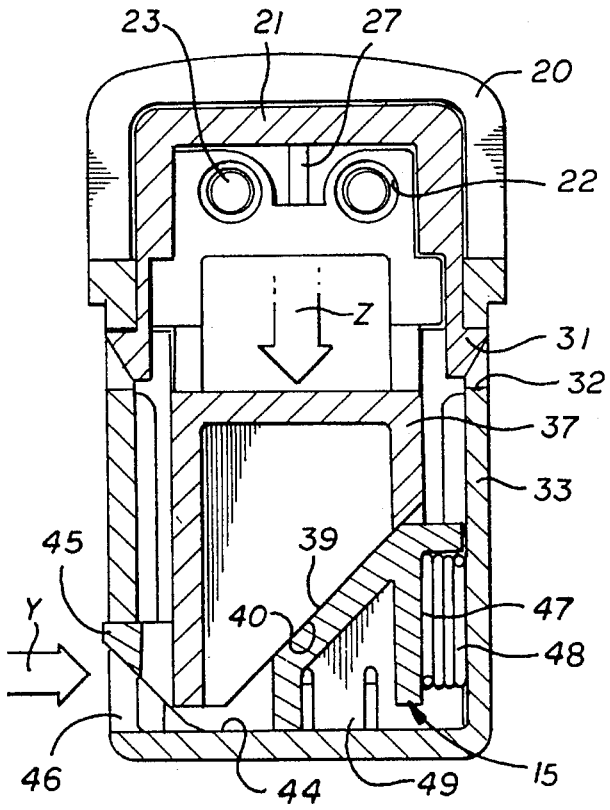
FIG. 6 is a sectional view taken along the line 6—6 of FIG. 4.
Figure 7:
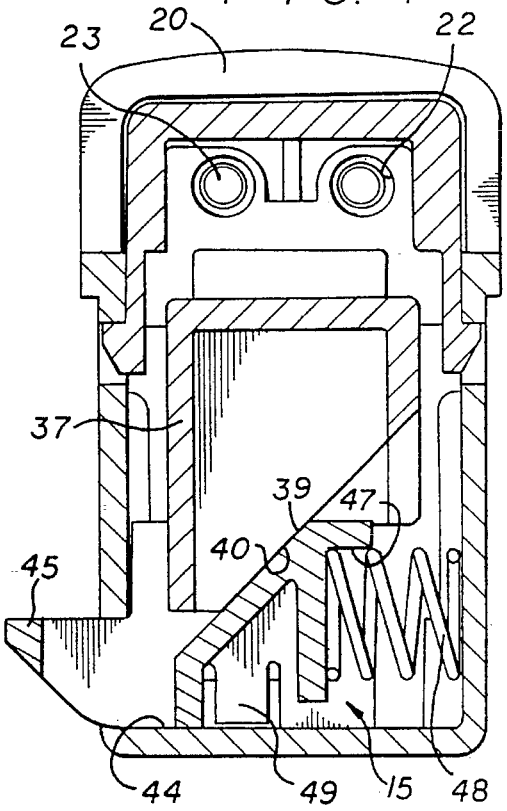
FIG. 7 is a sectional view taken along the line 7—7 of FIG. 5.
Figure 8:
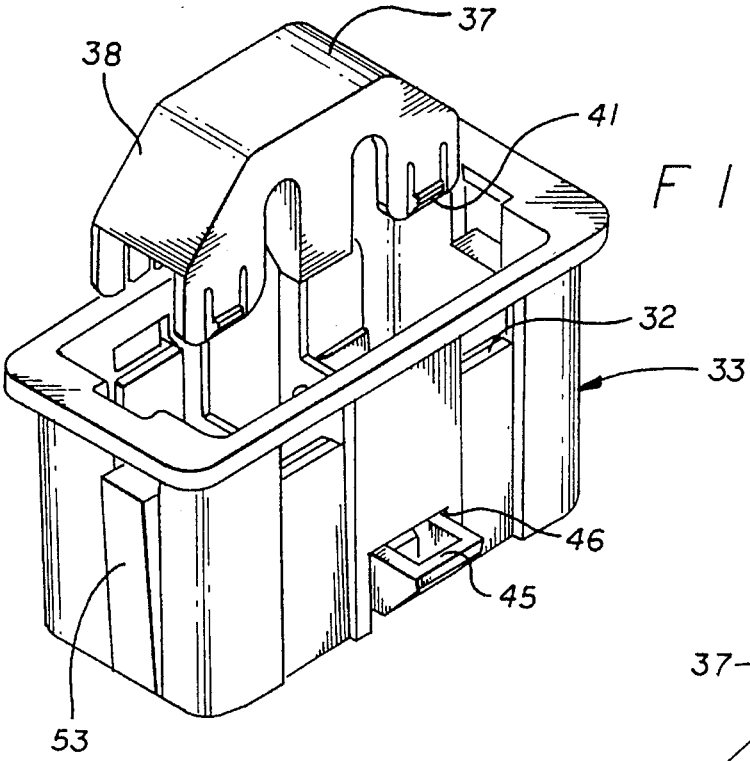
FIG. 8 is a perspective view illustrating a step in the assembly of the latch.
Figure 9:
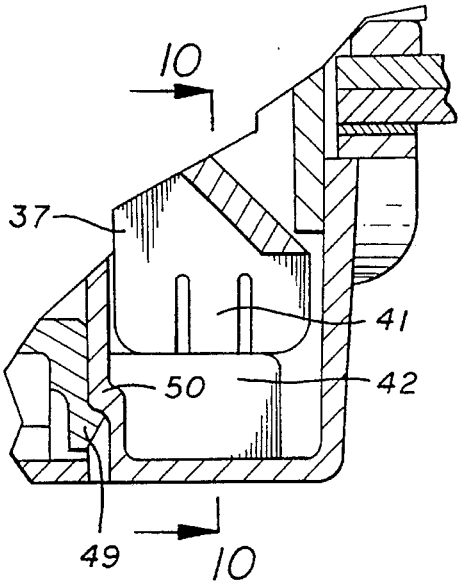
FIG. 9 is an enlarged partial sectional view illustrating positioning of the actuator in the housing.

The bolt 15 rests on the floor 44 of the housing 33, and has a sloped outer end 45 for projecting through an opening 46 of the housing. A depression 47 is provided in the opposite end of the bolt for enclosing a spring 48, which spring urges the bolt outward from the position of FIG. 6 to the position of FIG. 7. Flexible lugs 49 are provided on opposite sides of the bolt for positioning under shoulders 50 of bolt guide ribs 51 of the housing. See FIG. 4. Ribs 53 are provided on the exterior of the housing 33 for engagement with the retainer clip 14 when the latch is mounted in a door panel or the like.

The latch is installed from the exterior of a door panel through a rectangular cut-out. It is retained by the spring clip that slides across the two external ribs on the housing from the interior side of the door. The spring action of the retaining clip provides for a variation of door thickness. Alternatively, the sides of the housing could have cantilever lugs integrally molded on its sides. They would collapse when the latch was pushed through the door and snap back to retain the latch.

To unlatch the door, the handles are squeezed together, sliding over the guide which maintains the alignment. As the handles move inward along the X axis, the cam surface of the handles press on the cam surfaces of the actuator, causing the actuator to move downward along the Z axis. As the actuator moves downward, the cam surface of the actuator presses on the cam surface of the bolt, causing the bolt to slide back along the Y axis, thus releasing the bolt of the latch from the strike or keeper, after which the compression spring urges the bolt back to its original position. The cam surface of the bolt then pushes the actuator back to its original position. The handles are forced back to their original positions by the two compression springs that are guided over the mandrels and placed symmetrically about the X axis.

When the door on which the latch is mounted is closed, the angled surface of the bolt strikes the latching surface of the strike causing the bolt to move backward in direction Y. The handle springs maintain the handle positions while the bolt retracts. The bolt spring urges the bolt into the latched position.

I claim:

1. In a single-point latch for a door, the combination of:

a housing;

a bolt mounted in said housing for sliding along a first axis;

an actuator mounted in said housing for sliding along a second axis perpendicular to said first axis;

first and second handles mounted in said housing for sliding along a third axis perpendicular to said first and second axes;

first spring means carried in said handles for urging said handles apart;

said handles and said actuator having first interengaging cam surfaces for moving said actuator along said second axis by movement of said handles along said third axis toward each other;

said actuator and said bolt having second interengaging cam surfaces for moving said bolt inward into said housing along said first axis by said movement of said handles along said third axis; and second spring means carried in said housing for urging said bolt outward from said body to a latched position.

2. A latch as defined in claim 1 including a guide positioned in said housing between said handles and overlying said actuator, said guide having aligned slots along said third axis, and with each of said handles having a rib for sliding engagement with one of said guide slots.

3. A latch as defined in claim 2 wherein said actuator has sides with outwardly projecting lugs, and said housing has interior slide surfaces for engagement by said actuator lugs to provide slide friction between said actuator and housing.

4. A latch as defined in claim 3 wherein said bolt has sides with outwardly projecting lugs, and said housing has interior shoulders for engaging said bolt lugs to guide said bolt sliding in said housing along said first axis.

5. A latch as defined in claim 4 wherein said bolt outwardly projecting lugs are resilient and snap into place under said housing interior shoulders to hold said bolt in place, and said guide has outwardly projecting lugs which are resilient and snap into place in retainer means in said housing to hold said guide and handles in place with said actuator between said guide and bolt.

6. A latch as defined in claim 1 wherein said bolt has outwardly projecting lugs which are resilient, and said housing has interior shoulders, with said lugs snapping into place under said housing interior shoulders to hold said bolt in place, and said guide has outwardly projecting lugs which are resilient and snap into place in retainer means in said housing to hold said guide and handles in place with said actuator between said guide and bolt.

* * * * *